United States Patent [19]

Sheriff

[11] Patent Number: 4,673,949

[45] Date of Patent: Jun. 16, 1987

[54] WIDEBAND VHF/UHF RADIO ANTENNA WITH QUARTER-WAVE TRANSFORMER

[75] Inventor: Jack W. Sheriff, La Jolla, Calif.

[73] Assignee: Modublox & Co., Inc., La Jolla, Calif.

[21] Appl. No.: 653,697

[22] Filed: Sep. 24, 1984

[51] Int. Cl.[4] ..... H01Q 1/50; H01Q 9/30

[52] U.S. Cl. ..... 343/825; 343/864

[58] Field of Search ..... 343/745, 792, 790, 791, 343/864, 747, 850, 856, 860–863, 749, 750, 752, 825, 828; 455/292, 269, 281, 282; 333/35

[56] References Cited

U.S. PATENT DOCUMENTS

| | | | |
|---|---|---|---|
| 2,205,874 | 6/1940 | Buschbeck | 343/864 |
| 2,421,593 | 6/1947 | Bishop | 343/864 |
| 2,451,258 | 10/1948 | Trevor | 343/791 |
| 3,798,654 | 3/1974 | Martino et al. | 343/745 |
| 4,494,122 | 1/1985 | Garay et al. | 343/722 |
| 4,509,056 | 4/1985 | Ploussios | 343/791 |

*Primary Examiner*—Eli Lieberman
*Assistant Examiner*—Michael C. Wimer
*Attorney, Agent, or Firm*—Charmasson & Holz

[57] ABSTRACT

A radio antenna which operates over a broad frequency band, comprising a half-wave antenna tuned to a frequency beyond one cut-off frequency of the desired frequency band and a quarter-wave transformer tuned to a frequency beyond the other cut-off frequency at the other end of said band. The quarter-wave transformer acts as an impedance compensation device by canceling the reactive components of the half-wave antenna such novel reactive cancellation technique provides broadband performance while maintaining the antenna's gain and impedance characteristics.

11 Claims, 5 Drawing Figures

WIDEBAND VHF/UHF RADIO ANTENNA WITH QUARTER-WAVE TRANSFORMER

FIELD OF THE INVENTION

The present invention relates to antennas and, more particularly, to antennas suitable for mobile and portable use which are characterized by high sensitivity over a wide frequency range in the VHF and UHF bands.

BACKGROUND OF THE INVENTION

Following its approval of the cellular radio concept in April 1981, the Federal Communications Commission was deluged with license applications for the operation of cellular radio systems in the ninety largest U.S. markets. The enthusiastic, widespread adoption of cellular radio technology may well effect the greatest change in communications since the invention of the telephone. The advantage of cellular radio for mobile telephone systems is "frequency reuse," in which a limited spectrum of radio frequencies can be made to serve many users much as TV stations from one area to another reuse channels in the VHF band. Instead of covering an entire service area with one transmitter with high power and an elevated antenna, cellular service relies on transmitters of moderate power distributed throughout a service area, each of which is only powerful enough to communicate with the radio telephones in its immediate area or "cell." A central microprocessor teamed with more specialized radio equipment keeps track of each mobile unit and assigns new frequencies to the units as they move across the cell boundaries. Users will be able to move from one cellular system to another system without loss of service by a "roaming" feature that identifies foreign equipment to the new system and informs the home system of the user's location. Calls coming into the home system for the user are rerouted to the correct foreign system.

The low power requirement of cellular radio transceivers gives cellular radio another significant advantage over conventional radiotelephone systems: The cellular radio telephone can be made small enough to be carried in one hand.

In early 1982, AT&T estimated that the immediate pent-up demand for cellular radio systems was 1.5 million units at monthly charge of about $150 per month. [*Communications News,* March 1982, p. 36]. The demand for cellular radio systems is expected to grow rapidly. VFI Communications extimates that there will be a demand for up to 3.5 million cellular radio units by the mid-1980s and for more than 30 million units by the year 2000, with revenues rising from a multi-billion dollar figure within a year after start-up to $10–60 billion by 2000. [*Communications News,* September 1982 p. 20]. Some telecommunications experts are even more optimistic, and believe that cellular radio will completely replace the wired telephone network by soon after the turn of the century. [*Communications News,* August 1982, p. 46].

Because cellular radio operates in a full-duplex mode, separate frequencies are required for transmit and receive. Furthermore, crowding in the lower frequency ranges has prompted the FCC to specify frequencies closely approaching the GHz range for cellular radio operation, with 825–845 MHz and 870–890 MHz being stipulated for transmission and reception, respectively. This 65 MHz range of operation requires the use of an antenna having a very low voltage standing wave ratio (VSWR) and a nearly flat gain response over a relatively wide frequency range, with an effective bandwidth of about four percent. However, antennas of conventional design operating in the VHF or low UHF range, other than those of the discone and rhombic types, typically have VSWRs above 1.5 and narrow bandwidths no greater than two percent. Because of the narrowband characteristics of conventional antennas, which are usually of the half-way type, they are typically tuned to the center frequency of the transmit range, resulting in a severe mismatch in the receive range. One workable, albeit awkward, solution requires the use of two separate antennas; one being tuned to the center frequency of the transmit range, the other to the center frequency of the receive range.

SUMMARY OF THE INVENTION

In order to overcome the limitations of conventional antennas and to provide wideband antenna matching, the present invention uniquely utilizes a quarter-wave transformer both as an impedance matching device for coupling a coaxial transmission line from a transceiver to a half-wave antenna and as a series resonant circuit for canceling the reactive component of impedance for the half-wave antenna. Of course, it would be possible to connect the quarter-wave transformer directly to the transceiver, thus eliminating the coaxial transmission line. In such case, the quarter-wave transformer would function as an impedance matching device between the transceiver and the half-wave antenna. It has long been known that a quarter-wave open-ended transmission line acts as a series resonant circuit, and that a quarter-wave shorted transmission line acts as a complementary parallel resonant circuit. These characteristics have been exploited for years by using quarter-wave sections as impedance matching devices at their resonant frequencies. It has also long been known that a half-wave antenna acts as a parallel resonant circuit. In the present invention, an open-ended quarter-wave section and a half-wave antenna are combined, with the quarter-wave section tuned to the frequency below the lower cut-off frequency of the desired bandwidth and the half-wave antenna tuned to a frequency above the upper frequency at the other end thereof. Thus, at any frequency within the bandwidth, the reactive components of impedance for the quarter-wave and half-wave sections fully or partially cancel one another, resulting in a near-perfect impedance match over the entire bandwidth.

FIG. 3 is a graph showing the relative magnitudes of the reactive components of impedance as a function of frequency for both the quarter-wave transformer and the half-wave antenna. Frequency $f_1$ is the resonant frequency of the quarter-wave transformer, $f_2$ is the resonant frequency of the half-wave antenna, and the frequency range between $f_3$ and $f_4$ is the bandwidth of the antenna.

FIG. 4 is a schematic representation of the equivalent circuit for the instant antenna system. The components of this circuit are defined as follows: $Z_s$ is the source impedance of the transceiver and the transmission line at the input to the instant antenna; $Z_q$ is the impedance of the quarter-wave transformer; $X_c$ is the capacitive reactance; $C_{ins}$ is the capacitance introduced into the antenna system by an insulator which keeps the antenna in coaxial alignment with the quarter-wave transformer; $X_l$ is the inductive reactance; and $Z_a$ is the impedance of the half-wave antenna.

$Z_{qx}$, the impedance of the quarter-wave transformer at a frequency $f_x$ between $f_3$ and $f_4$, can be calculated by the following equation:

$$Z_{qx}=Z_{q1}[\cos\theta_1+j(\sin\theta_1)];$$

where $Z_{q1}$ is the impedance of the quarter-wave transformer at resonant frequency $f_1$, $\theta_1$, expressed in radians, is the shift in wavelength due to a frequency change from the resonant frequency $f_1$, and j is the indicator for the reactive component of impedance (+ when inductive and − when capacitive).

$Z_{ax}$, the impedance for the half-wave antenna at the frequency $f_x$, can be calculated by the following equation:

$$Z_{ax}=Z_{a2}[\cos\theta_2-j(\sin\theta_2];$$

where $Z_{a2}$ is the impedance of the half-wave antenna at resonant frequency $f_2$, and $\theta_2$, expressed in radians, is the shift in wavelength due to a frequency change from the resonant frequency $f_2$.

$$\theta_1=2L_q/\lambda_1,$$

where $L_q$ or $(k/f_1-k/f_x)$, is the change in wavelength for the quarter-wave transformer from $f_1$ to $f_x$, where k is a constant which relates wavelength and frequency.

Thus, $$2\pi\, L_q/\lambda_1 = 2\pi\, f_1 L_q/k = (2\pi\, f_1/k)(k/f_1 - k/f_x)$$
$$= 2\pi\,(1 - f_1/f_x),$$

and, $$\theta_2 = 2\pi\, L_h/\lambda_2 = (2\pi\, f_2/k)(k/f_x - k/f_2)$$
$$= 2\pi\,(f_2/f_x - 1)$$

Substituting these values of $0_1$ and $0_2$ into the impedance equations, the reactance equation for the coupled quarter-wave transformer and the half-wave antenna becomes $$Z_s = Z_{qx} + Z_{ax} =$$
$$Z_{ql}[\cos 2\pi\,(1 - f_1/f_x) + j\sin 2\pi\,(1 - f_1/f_x)] +$$
$$Z_{a2}[\cos 2\pi\,(f_2/f_x - 1) - j\sin 2\pi\,(f_2/f_x - 1)]$$

Because the coaxial transmission line is matched to the half-wave antenna by means of the quarter-wave matching transformer, $Z_{q1}$ and $Z_{a2}$ are equal. The equation for $Z_s$ therefore becomes:

$$Z_s = Z_{ql}[\cos 2\pi\,(1 - f_1/f_x) + \cos 2\pi\,(f_2/f_x - 1)] +$$
$$jZ_{ql}[\sin 2\pi\,(1 - f_1/f_x) - j\sin 2\pi\,(f_2/f_x - 1)].$$

It is evident from the foregoing equation that when $(1-f_1/f_x)=(f_2/f_x-1)$, the reactive components cancel. Therefore, $f_x=(f_2+f_1)/2$, where $f_x$ is the mean of frequencies $f_1$ and $f_2$. It is at this mean frequency where the optimum impedance match, or lowest VSWR occurs.

By substituting $f_1=800$ MHz and $f_2=900$ MHz in the equation for $Z_s$, the theoretical impedance for a 600-ohm, half-wave at any frequency in the cellular band, $f_x$, can be found.

That is

For $f_{825}$, $Z_sZ_{q1}[1.826-j0.349]$;

For $f_{850}$, $Z_s=Z_{q1}[2]$; and

For $f_{890}$, $Z_s=Z_{q1}[1.803+j0.523]$.

These calculations show that the real or resistive component at 825 and 890 MHz decreases less than ten percent as compared to that center frequency, 850 MHz, and that only a small resultant reactive component remains at the cut-off frequencies of the band. If resistive and reactive components are converted into lumped impedances for the purpose of VSWR computation by taking the square root of the sum of their squares, then $$Z_{s825}=Z_{q1}[1.86];$$

$$Z_{s850}=Z_{q1}[2];$$

and $$Z_{s890}=Z_{q1}[1.877].$$

Thus, the VSWR at the various frequencies within the cellular radio band is as follows:

At 825, the VSWR is then $2/1.86=1.075$;

at 850, the VSWR is 1.00; and at 890, the VSWR is $2/1.877=1.066$.

These theoretical VSWR calculations indicate significantly improved performance with the instant antenna arrangement as compared to VSWRs of 1.5 or greater for conventional half-wave antennas operating in the VHF or low UHF band. FIG. 5 is a graphic comparison of the VSWRs of the instant invention and a conventional half-wave antenna for frequencies in the 820–890 MHz range.

DESCRIPTION OF THE PREFERRED EMBODIMENT OF THE INVENTION

Figure 1:
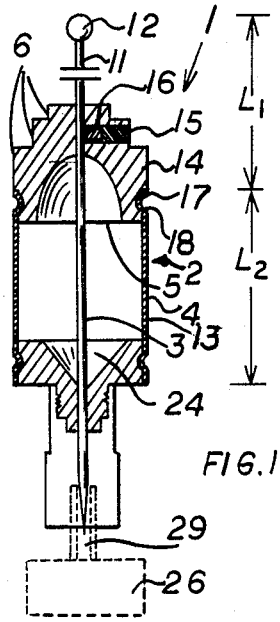
FIG. 1 is an sectional side view of the preferred embodiment of the invention.
Figure 3:
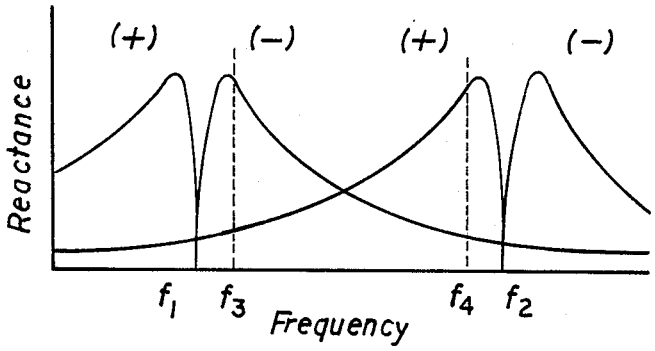
FIG. 3 is a graph showing the relative magnitude of the reactive components of impedance as a function of frequency for both the quarter-wave transformer and the half-wave antenna.
Figure 4:
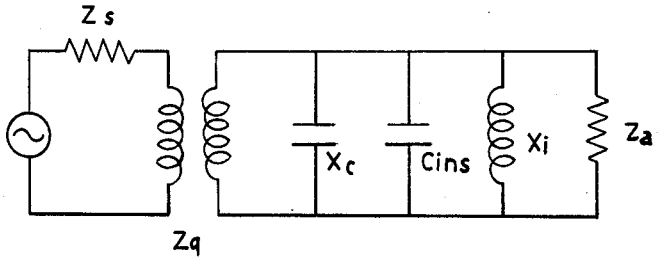
FIG. 4 is a schematic representation of an equivalent circuit for the antenna system.

In the preferred embodiment for use in the cellular radio band, the wide-band antenna system consists of a half-wave antenna 1 and a quarter-wave transformer 2. The quarter-wave transformer 2 is tuned to a resonant frequency of 800 MHz while the half wave antenna 1 is tuned to a frequency of 900 MHz. The transformer 2 is cylindrical in shape with center conductor 3 and outer conductor 4. For the sake of simplicity and ease of manufacture, a single flexible conductive rod 11 is used both for the half-wave antenna 1 and for the center conductor 3 for the quarter-wave transformer 2. The diameter of the rod 11 is chosen with two considerations in mind. First, it must be sufficiently rigid to withstand the typical mechanical forces imposed by exposure to the environment. Second, its diameter must not be so large that the diameter of the quarter-wave transformer's cylindrical conductor is inconveniently large.

The half-wave antenna has length $L_1$ as indicated in FIG. 1. For use in the cellular radio band (825–890 MHz), the rod's length is designed to be a half wavelength at 900 MHz. That is, the half-wave antenna is designed to resonate at a frequency which is above the upper cut-off frequency of 890 MHz and beyond the effective bandwidth. Typically, an antenna's bandwidth is defined by its upper and lower cut-off frequencies. These two frequencies are located at each end of the frequency band being utilized and are at the −3 dB points, where power is one-half of the antenna's maximum gain. Thus, $L_1$ extends from an aluminum ball 12, which caps rod 11 at its top end, to the bottom edge of the third tier of insulator 14.

Quarter-wave transformer 2 is comprised of a conductive tubular cylinder 13 with center conductor 3, outer conductor 4, and length $L_2$ as shown in FIG. 1. In the preferred embodiment, this transformer is designed to be a quarter wavelength at 800 MHz. That is, the quarter-wave transformer resonates at a frequency below the lower cut-off frequency of 825 MHz. Dimension $L_2$ is the entire length of tube 13.

Thus, it can be seen that the instant antenna, although operating within the cellular radio radio band of 825–890 MHz, is designed such that the half-wave antenna resonates at a frequency above the upper cut-off frequency, while the quarter-wave transformer resonates at a frequency below the lower cut-off frequency. With this novel design concept, the inventor has realized an antenna that effectively cancels the reactive impedance components over its effective bandwidth and results in wideband gain and impedance matching characteristics that are superior to those of conventional antennas.

Similarly, the above-described antenna will perform effectively if the resonant frequencies of the antenna and impedance-matching sections are interchanged. That is, reactive cancellation also occurs throughout the antenna's effective bandwidth when the half-wave antenna is tuned below the lower cut-off frequency and the quarter-wave transformer is tuned above the upper cut-off frequency.

Further, the claimed antenna operates not only in the cellular radio band, but throughout the VHF band and at UHF frequencies as well at 900 MHz. Since the resistive impedance of the quarter-wave transformer must be equal to the square root of the product of the impedances of the transmission line and the half-wave antenna in order to provide a proper match between the line and the antenna, the inside diameter of the copper tube 13 may be calculated using the formula for the resistive impedance of a pair of coaxial conductors in air: $Z=138 \log_{10} D/d$, where D is the inside diameter of the copper tube 13 and d is the diameter of the rod 11.

A toroidal insulator 14 is positioned between rod 11 and the top of tube 13. The insulator 14 is made of material such as nylon or nylatron and is shown in FIG. 1 with three upper tiers 6. The tiered appearance has no functional significance and is only ornamental.

Figure 2:
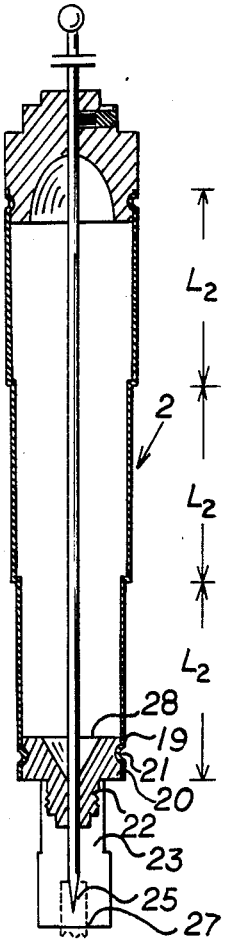
FIG. 2 is an sectional side view of a second embodiment of the instant invention showing a plurality of quarter-wave transformer sections.

On the other hand, minimizing the boundary effects between the half-wave antenna 1 and the quarter-wave transformer 2 is critical for optimal antenna performance. To minimize contact at the intersection of the half-wave antenna 1 and the quarter-wave transformer 2, and still maintain the rod 11 in coaxial relation with tube 13, the insulator 14 is intentionally designed to be undercut. That is, insulator 14 is not a solid piece, but is instead, bored out at its bottom end 5. A parabolically-shaped bore is shown in FIGS. 1 and 2, but any design which minimizes the boundary effects between the two selections is effective. Using an insulator which is not undercut, on the other hand, would generate high capacitance at the antenna's operating frequencies and the instant antenna would have sub-optimal performance. Further, insulator 14 is drilled and tapped to accept a set screw 15, which is tightened to apply pressure to one end of a nylon pin 16, which in turn secures the steel rod 11 and prevents the rod 11 from sliding within the insulator 14. An upper crimp groove 17 is machined in the insulator 14. In final assembly, the upper end of tube 13 is crimped with an upper circular crimp 18, which permanently secures insulator 14 in the tube 13.

A toroidal brass plug 19 having a lower circular crimp groove 20, is permanently crimped in place by means of a lower circular crimp 21 rolled into the tube 13 during final assembly. Plug 19 incorporates a threaded extension 22, to which a transceiver 26 with coaxial transmission line 27 can be attached by means of connector 23. A hole 24 is drilled through the central axis of the plug 19 and its threaded extension 22. The upper end 28 of hole 24 is tapered to smooth the impedance transition from the instant antenna, typically 600 ohms at VHF, to the 50-ohm coaxial transmission line 27. The diameter of hole 24 is calculated using the formula $Z_s=138 \log_{10} D/d$, where $Z_s$ is the impedance of the coaxial transmission line 27, D is the diameter of the hole 24, and d is the diameter of the rod 11. Further, bottom end 25 of rod 11 is tapered to establish a firm mechanical as well as an electrical connection with center conductor 29 of transmission line 27 and to minimize impedance changes at the junction between the instant antenna and the coaxial transmission line 27

Figure 5:
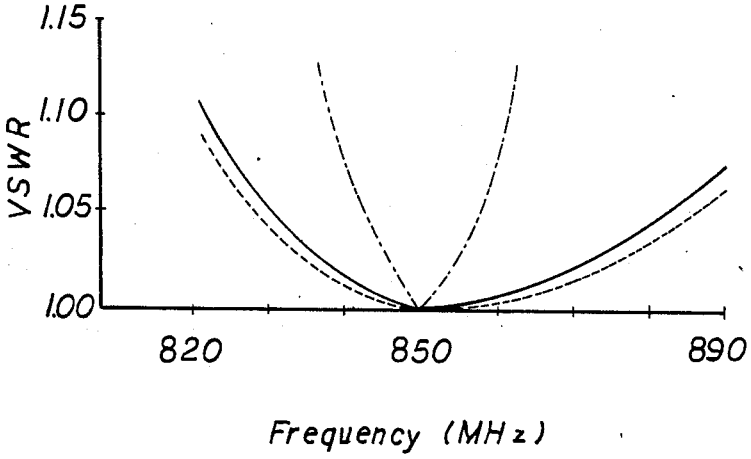
FIG. 5 is a graph of VSWR as a function of frequency for a conventional half-wave antenna and for the preferred embodiment of the invention.

FIG. 5 comprises three graphs of VSWR as a function of frequency. The first, marked by dot dashed lines is the graph for a conventional half-wave antenna. The second, marked by dashed lines is the theoretical graph for the preferred embodiment of the invention. The third, marked by a solid line is the empirical data for the preferred embodiment of the invention.

Many other embodiments within the scope and spirit of the invention are possible. For example, instead of using a single quarter-wave transformer to step-up the impedance from the level of the coaxial transmission line to the level of the half-wave antenna, multiple quarter-wave transformers of increasing resistive impedance can be connected end to end between the transmission line and the half-wave antenna, thus providing a more gradual step-up in resistive impedance and an even flatter curve for VSWR vs. frequency.

A multiple quarter-wave transformer embodiment can be constructed much like the single transformer embodiment already described. For example, in the case of a triple quarter-wave transformer embodiment 30, shown in FIG. 2, three cylindrical tubes 31, 32, 33 of different diameters, each having a length $L_2$ identical to the tube used in the single-transformer embodiment heretofore described, can be connected end to end, in order of increasing diameter, by means of two step-up flanges 34, 35. In such configuration, the largest diameter transformer 31 is positioned near the half-wave antenna, while the one 33 whose diameter is smallest is positioned near the coaxial transmission line. Thus, the bottom end of the smallest diameter tube would be connected to the coaxial transmission line in a manner similar to that used in the single-transformer embodiment, while the top end of the largest diameter tube will be crimped about the bottom of the insulator. As in the single-transformer configuration, the rod will serve as the half-wave antenna as well as the axial conductor for all three transformer sections. The rod would, of course, have to be extended to accommodate the two additional quarter-wavelength sections. If $Z_s$, $Z_1$, $Z_2$, $Z_3$ and $Z_h$ are the resistive impedances of the transmission line, the smallest diameter transformer, the medium diameter transformer, the largest diameter transformer and the half-wave antenna respectively, then $$Z_1=(Z_sZ_2)^{0.5},\ Z_2=(Z_1Z_3)^{0.5} \text{ and } Z_3=(Z_2Z_h)^{0.5}$$

The following claims are intended to cover the preferred embodiment, as well as additional embodiments such as the triple version briefly described above.

What is claimed is:

1. A wideband antenna for use with a transceiver operating over a bandwidth extending from a low frequency $F_3$ to a high frequency $F_4$, said transceiver having an antenna connecting impedance $Z_s$, which comprises:

a tubular element;

a toroidal insulator positioned at one end of said tubular element;

a toroidal conductive plug positioned at the other end of said tubular element;

a rod extending coaxially through and beyond said plug, tubular element and insulator, a section of said rod extending from said plug through said tubular element and forming in combination therewith, a quarterwave transformer, the remaining section of said rod extending through and beyond said insulator and forming a half-wave antenna having a resistive impedance $Z_a$;

means associated with said insulator for minimizing the boundary effect between said transformer and said half-wave antenna; and means associated with said plug for stepping up the resistive impedance of said transformer from the connecting impedance $Z_s$ to the resistive impedance $Z_a$ of said half-wave antenna.

2. The antenna claimed in claim 1, wherein said means for minimizing the boundary effect comprises the inner side of said insulator facing the tubular element defining a first cavity.

3. The antenna claimed in claim 2, wherein said means for stepping up the resistive impedance comprises the inner side of said plug facing said tubular element defining a second cavity.

4. The antenna claimed in claim 3 which further comprises means associated with the outer side of said plug for connecting said rod to said transceiver.

5. The antenna claimed in claim 4, wherein said half-wave antenna is tuned to a resonant frequency $F_1$ higher than said high frequency $F_4$; and said quarter-wave transformer is tuned to a resonant frequency $F_2$ lower than said low frequency $F_3$.

6. The antenna claimed in claim 5, wherein said quarter-wave transformer is sized and dimensioned to exhibit a resistive impedance $Z_q=(Z_sZ_a)^{0.5}$.

7. The antenna claimed in claim 5, wherein said plug is made from electroconductive material and said second cavity has a generally conical shape tapering down from the inner face of the plug toward said means for connecting.

8. The antenna claimed in claim 5, wherein said first cavity has a generally parabolical shape coaxial with said rod.

9. The antenna claimed in claim 7, wherein said tubular element comprises a plurality of interconnected sections having different diameters.

10. The antenna claimed in claim 9, wherein the lengths and diameters of said sections are dimensioned to define a plurality of quarter-wave transformers.

11. The antenna claimed in claim 4, wherein said half-wave antenna is tuned to a resonant frequency $F_2$ lower than said low frequency $F_3$; and said quarter-wave transformer is tuned to a resonant frequency $F_1$ higher than said high frequency $F_4$.

* * * * *